US007665407B2

(12) United States Patent
Hwang et al.

(10) Patent No.: US 7,665,407 B2
(45) Date of Patent: Feb. 23, 2010

(54) CYCLONIC PLASMA PYROLYSIS/VITRIFICATION SYSTEM

(75) Inventors: Soon Mo Hwang, Daejeon (KR); Young Suk Kim, Daejeon (KR); Cheal Jin Doh, Daejeon (KR)

(73) Assignee: Adplatech Corporation, Daejeon (KR)

( * ) Notice: Subject to any disclaimer, the term of this patent is extended or adjusted under 35 U.S.C. 154(b) by 76 days.

(21) Appl. No.: 10/599,816

(22) PCT Filed: Aug. 25, 2004

(86) PCT No.: PCT/KR2004/002136

§ 371 (c)(1),
(2), (4) Date: Jun. 13, 2007

(87) PCT Pub. No.: WO2005/106327

PCT Pub. Date: Nov. 10, 2005

(65) Prior Publication Data

US 2007/0251434 A1 Nov. 1, 2007

(30) Foreign Application Priority Data

Apr. 29, 2004 (KR) ..... 10-2004-0030090

(51) Int. Cl.
*F23G 5/00* (2006.01)
*F23G 5/12* (2006.01)

(52) U.S. Cl. ..... 110/250; 110/229

(58) Field of Classification Search ..... 110/346, 110/229, 266, 341, 210, 212, 250, 348, 252
See application file for complete search history.

(56) References Cited

U.S. PATENT DOCUMENTS 3,357,383 A * 12/1967 Golovanov et al. ..... 110/266
4,831,944 A * 5/1989 Durand et al. ..... 110/346
5,280,757 A * 1/1994 Carter et al. ..... 110/250
5,640,913 A * 6/1997 Nyyssonen ..... 110/212
6,155,182 A * 12/2000 Tsangaris et al. ..... 110/250
6,883,442 B1 * 4/2005 Groszek et al. ..... 110/341
7,228,806 B2 * 6/2007 Dueck et al. ..... 110/266

FOREIGN PATENT DOCUMENTS

| | | |
|---|---|---|
| JP | 02-122109 | 5/1990 |
| JP | 03-055411 | 3/1991 |
| JP | 05-231624 | 9/1993 |
| JP | 05-340524 | 12/1993 |
| JP | 06-307622 | 11/1994 |
| JP | 10-103634 | 4/1998 |
| JP | 11-063463 | 3/1999 |
| JP | 11-287412 | 10/1999 |
| JP | 2000-035208 | 2/2000 |
| WO | WO 97/49641 | 12/1997 |

* cited by examiner

*Primary Examiner*—Kenneth B Rinehart
*Assistant Examiner*—David J Laux
(74) *Attorney, Agent, or Firm*—Lowe Hauptman Ham & Berner LLP

(57) ABSTRACT

The present invention relates to a cyclonic plasma pyrolysis/vitrification system pyrolyzing and vitrifying waste materials into exhaust gas and slag using a plasma torch. The plasma torch circulates the exhaust gas in a main reactor with a maximum circulating power by strong plasma jet, and makes flyashes contained in the circulating exhaust gas to be melted after being adsorbed at the inner walls or in the melted materials of waste at the bottom of the main reactor by a centrifugal force. Accordingly, discharge of flyashes containing toxic materials to the outside is prevented, and pyrolysis and gasification of the waste materials are induced by circulating the exhaust gas rapidly.

8 Claims, 4 Drawing Sheets

CYCLONIC PLASMA PYROLYSIS/VITRIFICATION SYSTEM

TECHNICAL FIELD

The present invention relates generally to a pyrolysis/vitrification system for treating waste materials and, more particularly, to a plasma pyrolysis/vitrification system utilizing plasma with low mass, ultra high temperature and high enthalpy to transform organic waste materials into fuel gas by pyrolysis and gasification, and inorganic waste materials into harmless recyclable slag by melting simultaneously.

BACKGROUND ART

Recently the amount of industrial/household waste materials is increasing rapidly due to fast industrialization and population growth. Landfill is generally used for treating the waste materials. However, the landfill may not be a perfect solution due to shortage of landfill sites, and contamination of underground water and soil. Based on incineration, various new technologies having advantages such as volume reduction and energy recycling have been developed, and are being used currently. However, they have a disadvantage of generating harmful exhaust gases such as dioxin, and residual ashes containing heavy metals.

To solve the above-mentioned problems, technologies for pyrolysis/melting using a plasma torch have been developed and applied to treat the waste materials more efficiently. The plasma torch generates extremely high temperature plasma jet by applying highly pressurized arc to ionized plasma gas. High temperature environment ranging from 4,000 to 7,000 degrees Centigrade is generally created by the plasma torch.

Plasma torches are generally classified into non-transferred torch and transferred torch depending on their structures. The plasma generator includes electrodes, nozzles, gas inflow system and cooling system as main components. Copper is generally used for an anode material and tungsten treated for easy electron emission is used for a cathode material.

Various transferred or non-transferred plasma torches with the capacity ranging from hundreds Kilowatts to Megawatts are being developed, depending on materials to be treated. Plasma torch technologies for pyrolysis/melting are used for treating waste materials utilizing high temperature plasma of various gases. Organic compounds are decomposed into combustion gases and chemically stable compounds such as C, CnHm, CO, and $H_2$, by high temperature and heat capacity of the plasma torch. Inorganic compounds are melted and decomposed into very minute materials, or vitrified into solids.

Accordingly, if harmful wastes or coal are treated using the plasma torch, purified combustion gases free from harmful materials are produced by pyrolysis and may thereby be reused. Volume of the waste materials may be substantially reduced by vitrification in a non-dissolvable form due to melting.

DISCLOSURE

Technical Problem

However, plasma pyrolysis/vitrification systems reported till now have a disadvantage that a large quantity of flyashes is floated by strong plasma jet and considerable portions of floated flyashes are discharged to the outside. To reduce them, plasma jet injected from the plasma torch may be configured to contact waste materials directly. However, in this case, pyrolysis/melting reaction of the waste materials is decreased rapidly, and it is inevitable that some portion of flyashes is discharged to the outside with the flow of exhaust gas in a main reactor, in which the waste materials are pyrolyzed and melted by the plasma torch.

The advantage of plasma treatment that volume of landfill is decreased may be offset when the volume of the flyashes is large, because the flyashes discharged to the outside should be either re-treated after collecting in a gas purification equipment or landfilled.

Accordingly, development of new plasma pyrolysis/vitrification system is urgently required so that the advantage of the plasma pyrolysis/vitrification system is maximized and the flyashes are prevented from being discharged to the outside when waste materials are treated.

TECHNICAL SOLUTION

The present invention is provided to solve the above-described problems of conventional technologies. It is an object of the present invention to provide a cyclonic plasma pyrolysis/vitrification system that can significantly reduce flyashes containing a large quantity of toxic materials such as heavy metals to be discharged to the outside.

To achieve the above-mentioned technical objects, a plasma torch is provided to circulate exhaust gases which are generated by pyrolysis and melting of waste materials in a main reactor, by a strong plasma jet with a maximum circulating power. Flyashes contained in the circulating exhaust gas are melted after being adsorbed at the inner walls or in the melted materials of wastes at the bottom of the main reactor by a centrifugal force. Discharge of flyashes containing toxic materials to the outside is thereby prevented, and effective pyrolysis and gasification reaction of waste materials is induced by rapid circulation of the exhaust gas.

Additionally, the present invention provides a plasma pyrolysis/vitrification system that enables smooth discharge of slag by forming a slag outlet just under the plasma torch to maintain the slag at a high temperature.

Hereinafter, the present invention will be described in more detail.

The present invention relates to a cyclonic plasma pyrolysis/vitrification system which generates exhaust gas and slag by pyrolysis and melting of waste materials using a plasma torch. The cyclonic plasma pyrolysis/vitrification system comprises: a main reactor having a waste inlet through which waste materials are supplied, an exhaust gas outlet through which exhaust gas is discharged, and a slag outlet through which slag is discharged; a plasma torch inclined at a predetermined angle with respect to the internal bottom surface of the main reactor to give a maximum circulating power to the exhaust gas, pyrolyzing and vitrifying the waste materials; an auxiliary reactor connected to the exhaust gas outlet of the main reactor, discharging the exhaust gas to the outside; a slag discharger connected to the slag outlet of the main reactor, discharging the slag to the outside; wherein the plasma torch circulates the exhaust gas in the main reactor by strong plasma jet with a maximum circulating power, and makes flyashes contained in the circulating exhaust gas to be melted after being adsorbed at the inner walls or in the melted materials of wastes at the bottom of the main reactor by a centrifugal force.

Preferably, the cyclonic plasma pyrolysis/vitrification system in accordance with the present invention has the slag discharger formed just under the plasma torch.

Preferably, the cyclonic plasma pyrolysis/vitrification system in accordance with the present invention includes the waste inlet and the ex wherein the cyclonic gas flow rotates throughout substantially the entire main reactor; haust gas outlet having a designated distance therebetween in the main reactor, and further includes a separator wall of a designated length formed therebetween.

Preferably, in the cyclonic plasma pyrolysis/vitrification system in accordance with the present invention, the exhaust gas outlet is disposed in the center of the circulating exhaust gas, namely, in the center of an inner sidewall of a main reactor.

Preferably, in the cyclonic plasma pyrolysis/vitrification system in accordance with the present invention, the plasma torch is inclined at the angle ranging from 20 to 40 degrees with respect to the bottom surface of the main reactor.

DESCRIPTION DRAWINGS

BEST MODE

Hereinafter, example embodiments of the present invention will be described in more detail with reference to the accompanying drawings.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

EXAMPLE 1

Figure 1:
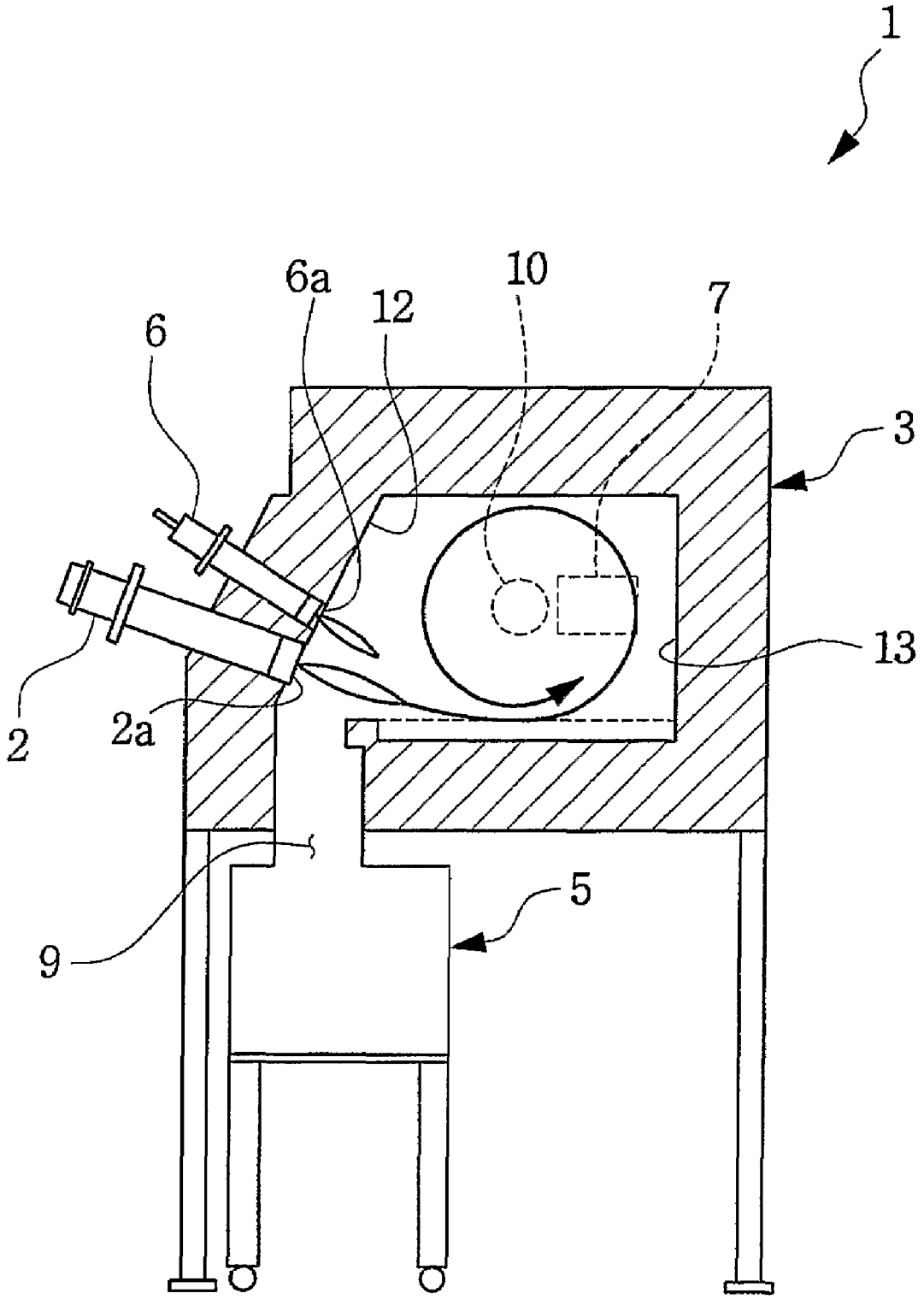
FIG. 1 is a partial sectional view showing a cyclonic plasma pyrolysis/vitrification system in accordance with Example 1 of the present invention.
Figure 2:
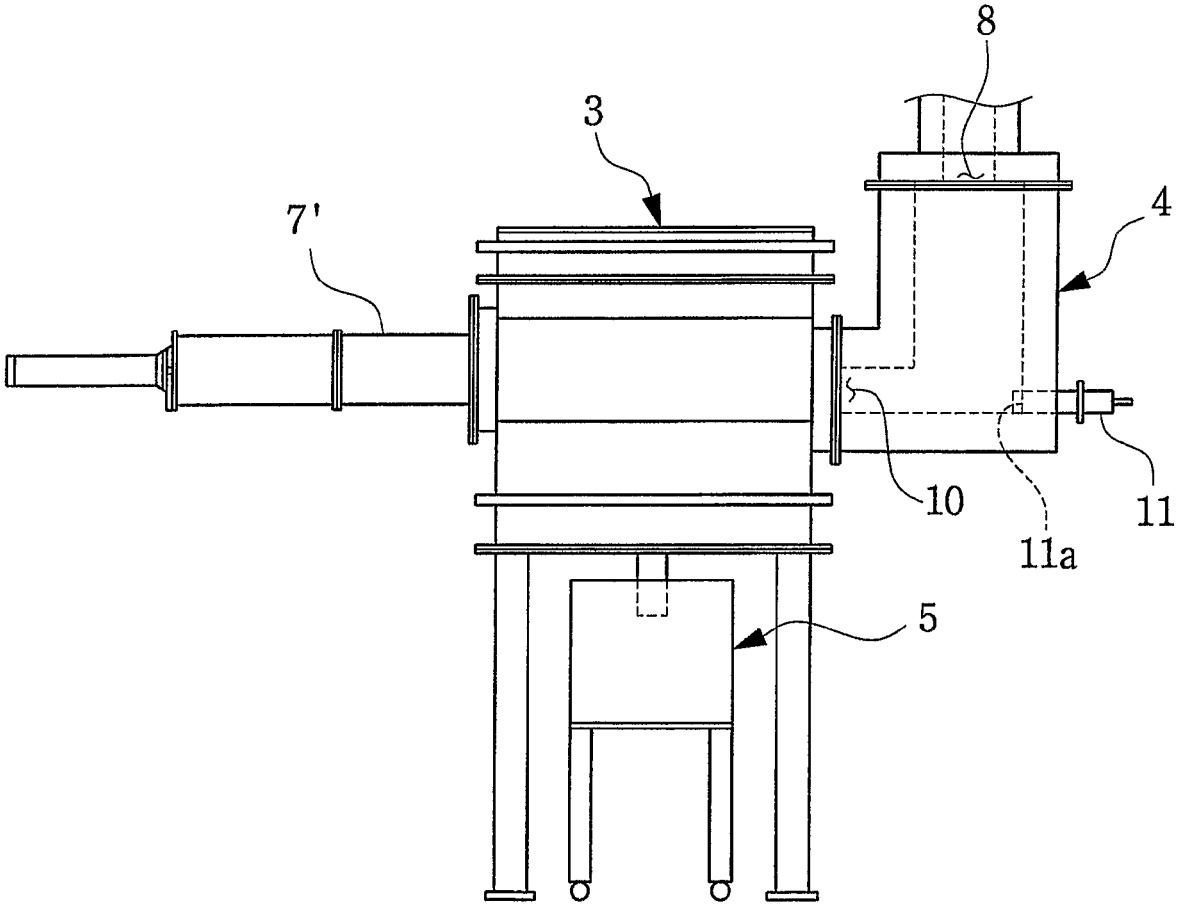
FIG. 2 is a partial side view showing the cyclonic plasma pyrolysis/vitrification system in accordance with Example 1 of the present invention.

FIG. 1 is a partial sectional view showing a cyclonic plasma pyrolysis/vitrification system in accordance with Example 1 of the present invention and FIG. 2 is a partial side view showing the cyclonic plasma pyrolysis/vitrification system in accordance with Example 1 of the present invention.

Referring to FIGS. 1 and 2, a cyclonic plasma pyrolysis/vitrification system 1 is an equipment used for pyrolyzing and vitrifying waste materials. The cyclonic plasma pyrolysis/vitrification system 1 comprises a plasma torch 2 pyrolyzing and vitrifying the waste materials, a main reactor 3 generating exhaust gas and slag by pyrolyzing and vitrifying the waste materials using the plasma torch 2, an auxiliary reactor 4 to which the exhaust gas generated in the main reactor 3 is supplied and which discharges the exhaust gas to the outside, and a slag discharger 5 to which the slag generated in the main reactor 3 is supplied and which discharges the slag to the outside. The main reactor 3 has a waste inlet 7 formed on a side of its inner wall through which waste materials are fed by a hydraulic feeding device 7' and a plasma torch injection hole 2*a* formed on a wall 12 perpendicular to the waste inlet 7. The plasma torch 2 is installed in the plasma torch injection hole 2*a* at the angle ranging from 20 to 40 degrees with respect to the bottom surface of the main reactor 3 so that exhaust gas circulates with maximum circulating power inside the main reactor 3. A slag outlet 9 is formed just under the plasma torch 2 so that high temperature is maintained by the heat of the plasma torch 2. A first gas burner injection hole 6*a* is formed in a side of the plasma torch 2. A first gas burner 6 is installed in the first gas burner injection hole 6*a* towards the center of bottom of the main reactor 3 to preheat the main reactor 3 together with the plasma torch 2. A first exhaust gas outlet 10 is formed in the center of an inner wall of the main reactor 3, the axis of circulating exhaust gas, which is located opposite to the waste inlet 7. Exhaust gas is circulated at maximum circulating power in a space between the wall 12 having the plasma torch 2 and the other wall 13 opposite to the wall 12, and flyashes contained in the exhaust gas are thereby melted after being adsorbed into melted materials of wastes (not shown) at the bottom surface, at the wall 12 or at the other wall 13 by a centrifugal force. Accordingly, exhaust gas containing relatively low concentration of flyashes, existing in the center of circulating exhaust gas, is discharged through the first exhaust gas outlet 10.

An auxiliary reactor 4 coupled with the first exhaust gas outlet 10 is installed at a side of the main reactor 3, and exhaust gas from the main reactor 3 is delivered to the auxiliary reactor 4. A second gas burner injection hole 11*a* is formed on an inner wall of the auxiliary reactor 4, opposite to the first exhaust gas outlet 10.A second gas burner 11 is installed in the second gas burner injection hole 11*a*, circulates and heats the exhaust gas. A second exhaust gas outlet 8 is formed on the ceiling of the auxiliary reactor 4 and the exhaust gas is discharged through the second exhaust gas outlet 8 to a gas purification equipment (not shown) connected thereto.

A slag discharger 5 is formed under the main reactor 3 and connected to a slag outlet 9 formed just under the plasma torch 2. Slag generated in the main reactor 3 is delivered smoothly to the slag discharger 5 by maintaining high temperature using the heat of the plasma torch 2. A slag treatment system (not shown) may be installed inside the slag discharger 5 to treat the slag.

EXAMPLE 2

Figure 3:
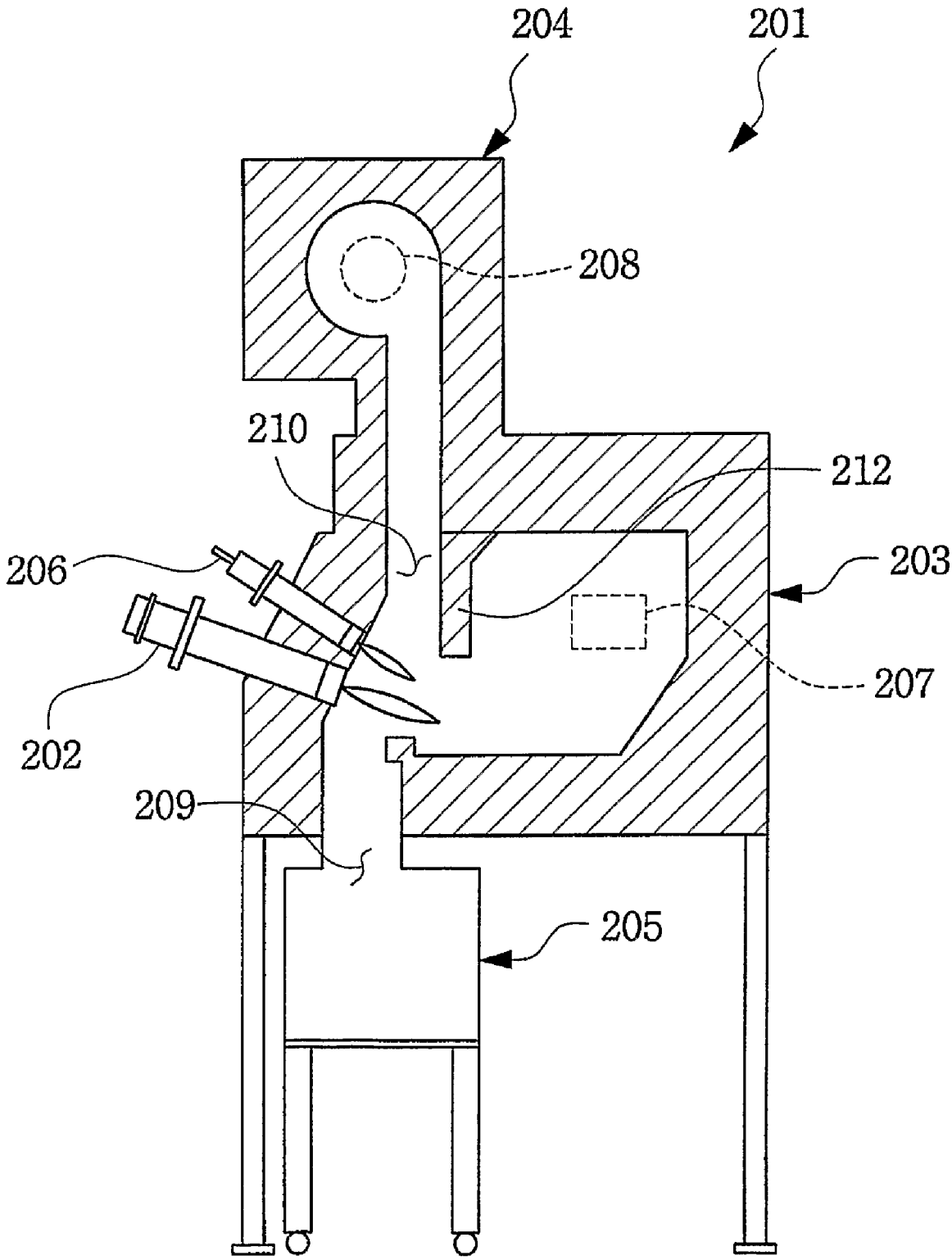
FIG. 3 is a partial sectional view showing a cyclonic plasma pyrolysis/vitrification system in accordance with Example 2 of the present invention.
Figure 4:
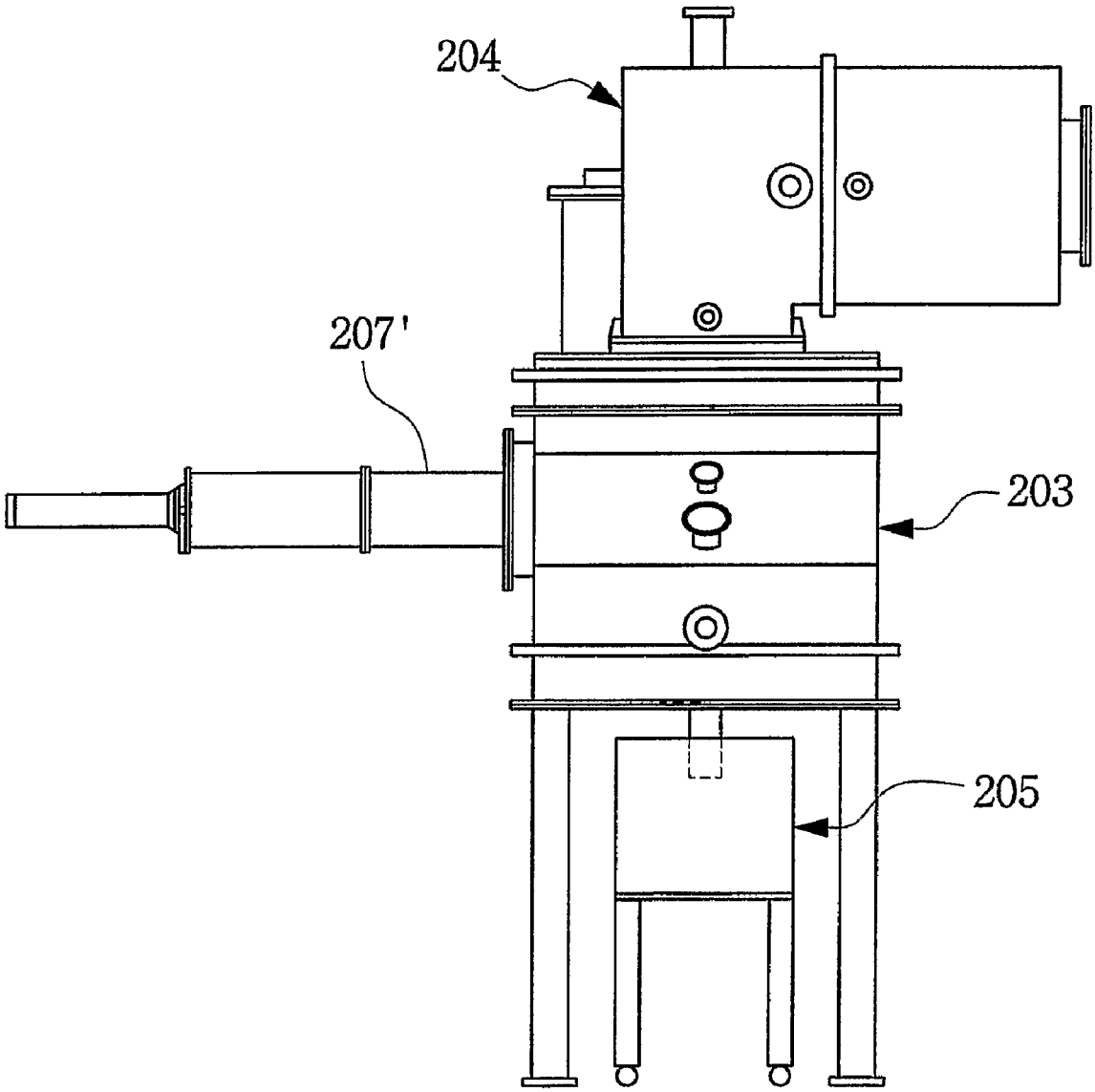
FIG. 4 is a partial side view showing the cyclonic plasma pyrolysis/vitrification system in accordance with Example 2 of the present invention.

FIG. 3 is a partial sectional view showing a cyclonic plasma pyrolysis/vitrification system in accordance with Example 2 of the present invention and FIG. 4 is a partial side view showing the cyclonic plasma pyrolysis/vitrification system in accordance with Example 2 of the present invention.

Referring to FIGS. 3 and 4, a cyclonic plasma pyrolysis/vitrification system 201 is an equipment for pyrolyzing and vitrifying waste materials, in the same manner as Example 1 shown in FIG. 1. The cyclonic plasma pyrolysis/vitrification system 201 comprises a plasma torch 202 pyrolyzing and vitrifying waste materials, a main reactor 203 generating exhaust gas and slag by pyrolyzing and vitrifying the waste materials using the plasma torch 202, an auxiliary reactor 204 to which the exhaust gas generated in the main reactor 203 is fed and which discharges the exhaust gas to the outside, and a slag discharger 205 to which the slag generated in the main reactor 203 is fed and which discharges the slag to the outside.

In the same manner as Example 1 shown in FIG. 1, the main reactor 203 has a waste inlet 207 formed on a side of its inner wall through which waste materials are fed by a hydraulic feeding device 207' and a plasma torch injection hole 202*a* formed on an inner wall perpendicular to the waste inlet 207. The plasma torch 202 is installed in the plasma torch injection hole 202*a* at the angle ranging from 20 to 40 degrees with respect to the bottom surface of the main reactor 203 so that exhaust gas circulates with maximum circulating power inside the main reactor 203. A slag outlet 209 is formed just under the plasma torch 202 so that high temperature is maintained by the heat of the plasma torch 202. A first gas burner injection hole 206*a* is formed in a side of the plasma torch 202. A first gas burner 206 is installed in the first gas burner injection hole 206*a* towards the center of the main reactor 203 to preheat the main reactor 203 together with the plasma torch 202.

In a different manner from Example 1 shown in FIGS. 1 and 2, a first exhaust gas outlet 210 is formed in the ceiling of the main reactor 203 opposite to the slag outlet 209, and exhaust gas is discharged through the first exhaust gas outlet 210. An auxiliary reactor 204 coupled with the first exhaust gas outlet 210 is installed on the top of the main reactor 203, and exhaust gas from the main reactor 203 is delivered to the auxiliary reactor 204. A second exhaust gas outlet 208 is formed on a side of an inner wall of the auxiliary reactor 204, and discharges the exhaust gas to a gas purification equipment (not shown) connected thereto. A separator wall 212 is installed between the waste inlet 207 and the first exhaust gas outlet 210 to vitrify all flyashes generated during pyrolysis of waste materials by effectively circulating exhaust gas including flyashes. The separator wall 212 is protruded at a designated length from the inner ceiling of the main reactor 203 towards its bottom so that the plasma torch 203 can heat the bottom of the main reactor 203. The separator wall 212 is located between a space in the main reactor 203 to which waste materials are introduced and the plasma torch 202. So that the separator wall 212 may be provided to make flyashes to circulate more than one times in the main reactor 203 before discharge from the main reactor 203. Exhaust gas passes near the highest temperature region of the plasma jet in the main reactor 203 before discharge from the main reactor 203 so that un-melted flyashes are melted and undestroyed organic components are destroyed. Other structures of the pyrolysis/vitrification system 201 according to Example 2 of the present invention will not be explained because they have the same structures as Example 1 shown in FIG. 1.

Referring to FIGS. 1 and 2, waste treatment process of the cyclonic plasma pyrolysis/vitrification system 1 according to Example 1 of the present invention will be described. The plasma pyrolysis/vitrification system 1 has a preheating process for preheating its inside. In the case that waste materials are treated by a plasma torch 2 without preheating, a large quantity of environmentally toxic materials and un-burned soots are discharged. Exhaust gases containing toxic materials and soots are discharged through an auxiliary reactor 4, delivered to a gas purification equipment (not shown), and result in the reduction of the lifetime of the gas purification equipment.

Gas is supplied to the inside of the pyrolysis/vitrification system 1 through a first gas burner 6 installed in the main reactor 3. The gas supplied to the main reactor 3 is ignited by plasma jet injected from plasma torch 2 and preheats the main reactor 3. In the case that the inside of the main reactor 3 is preheated only by the plasma torch 2, a large quantity of NOx may be generated because oxidation atmosphere is formed by high temperature of the plasma jet. Accordingly, Excessive quantity of gas is injected by the first gas burner 206 to reduce the occurrence of NOx, and reduction atmosphere is formed in the main reactor 3 when the quantity of gas remaining after burning is larger than oxygen injected into the pyrolysis/vitrification system through the plasma torch 2. Internal temperature of main reactor 3 is above 1,400 degrees Centigrade at which slag produced during waste treatment is melting. Subsequently, if the temperature of the auxiliary reactor 4 is below 1,300 degrees Centigrade which is a normal operating temperature, temperature of the gas supplied from the main reactor 3 to the auxiliary reactor 4 is further raised using a second gas burner 11 installed in the auxiliary reactor 4. Waste materials are pressed by hydraulic feeding device and supplied into the preheated main reactor 3 through a waste inlet 7 formed on a side of the main reactor 3. Supplied waste materials are pyrolyzed and melted by the plasma torch 2 and high temperature atmosphere, and slag and exhaust gas containing toxic flyashes are generated. The plasma torch 2 is inclined at a predetermined angle with respect to the bottom surface of the main reactor, and maximum circulating power is given to exhaust gas by plasma jet injected from the plasma torch 2. The exhaust gas is circulated at a maximum circulating power in a space between a wall 12 on which the plasma torch 2 is installed and another wall 13 opposite to the wall 12. Flyashes contained in the exhaust gas are melted after being absorbed by a centrifugal force into the wall 12, the other wall 13 and melted materials at which temperature above 1,400 degrees Centigrade is maintained by the plasma torch 202. Therefore, slag free from toxic materials, such as dioxin or furan contained in the flyashes, is generated.

Concentration of flyashes is relatively low in the center of the circulating gas and thereby a first exhaust gas outlet 10 discharges exhaust gas purified maximumly in the center of circulating exhaust gas. A slag outlet 9 is formed just under the plasma torch 2, and generated slag is discharged smoothly to a slag discharger 9 by maintaining high temperature.

In the cyclonic plasma pyrolysis/vitrification system according to Example 2 of the present invention shown in FIGS. 3 and 4, exhaust gas is circulated rapidly by plasma jet ejected from the inclined plasma torch in an internal space between an inner wall having a waste inlet 207, and a separator wall 212 formed between the waste inlet 207 and a plasma torch injection hole 202*a*. Slag free from toxic materials is obtained by vitrifying and making flyashes contained in the exhaust gas to be absorbed into an inner wall and melted materials that maintain a temperature above 1,400 degrees Centigrade. Accordingly, By the action of the separator wall 212 formed in the main reactor 203, even some portion of the exhaust gas containing flyashes is circulated without discharge to a first exhaust gas outlet 210, and thereby possibility of vitrifying flyashes is increased more. Exhaust gas purified maximumly by efficient circulation is delivered to an auxiliary reactor 204 through the first exhaust gas outlet 210, discharged to outside through a second exhaust gas outlet 208 formed on an inner sidewall of the auxiliary reactor 204, and discharge of flyashes to the outside is prevented. In the case that a large capacity of waste treatment is required, a plurality of plasma torch 202 is installed in a parallel arrangement for efficient circulation.

INDUSTRIAL APPLICABILITY

A cyclonic plasma pyrolysis/vitrification system according to the present invention has a plasma torch inclined at a predetermined angle with respect to the bottom surface of a main reactor so that exhaust gas is circulated by plasma jet at maximum circulating power in the main reactor, slag is maintained in a melted state, flyashes contained in circulating exhaust gas is melted after being adsorbed at the inner walls or in the melted materials of wastes at the bottom of the main reactor by a centrifugal force, discharge of flyashes to the outside is prevented, and pyrolysis and gasification of waste materials are activated by circulating exhaust gas.

The cyclonic plasma pyrolysis/vitrification system according to the present invention has a separator wall formed between a waste inlet and an exhaust gas outlet so that all exhaust gas is circulated effectively, discharged to an outlet and melted ratio of the flyashes becomes higher.

A slag outlet is formed just under a plasma torch, and slag is discharged smoothly to the slag outlet by maintaining the slag in a high temperature.

The cyclonic plasma pyrolysis/vitrification system according to the present invention is applicable to urban and industrial wastes, and especially useful for vitrifying powder type wastes such as flyashes.

The invention claimed is:

1. A cyclonic plasma pyrolysis/vitrification system pyrolyzing and vitrifying waste materials into exhaust gas and slag using a plasma torch, the system comprising:

a main reactor having a waste inlet supplying waste materials, an exhaust gas outlet for discharging exhaust gas, and a slag outlet for discharging slag;

a plasma torch inclined at a predetermined angle with respect to the internal bottom surface of the main reactor to induce a single cyclonic gas flow which rotates about an essentially horizontal axis above the bottom surface of the main reactor for, pyrolyzing and vitrifying the waste materials in the main reactor; wherein the cyclonic gas flow rotates throughout substantially the entire main reactor;

a gas burner arranged with the plasma torch to direct a flame into the main reactor in manner to promote heating of the main reactor;

an auxiliary reactor connected to the exhaust gas outlet of the main reactor, for discharging exhaust gas;

a slag discharger connected to the slag outlet of the main reactor, for discharging the slag;

wherein the plasma torch circulates the gas in the main reactor and subjects flyashes contained in the circulating exhaust gas to centrifugal force, causing the flyash to melt and to be absorbed into molten waste materials on both inner walls and the bottom surface of the main reactor.

2. The cyclonic plasma pyrolysis/vitrification system of claim 1 wherein the slag discharger is formed just under the plasma torch.

3. The cyclonic plasma pyrolysis/vitrification system of claim 1, including the waste inlet located in a side wall of the main reactor and located to deliver waste material essentially horizontally into the cyclonic gas flow, and wherein the exhaust gas outlet opens into the main reactor a designated distance from the waste inlet, and wherein the main reactor has a downwardly extending separator wall of designated length formed therein.

4. The cyclonic plasma pyrolysis/vitrification system of claim 1, wherein the exhaust gas outlet is disposed in essentially a center of an inner wall of the main reactor.

5. The cyclonic plasma pyrolysis/vitrification system of claim 1, wherein the plasma torch is inclined at the angle ranging from 20 to 40 degrees with respect to the bottom surface of the main reactor.

6. The cyclonic plasma pyrolysis/vitrification system of claim 1, further comprising an auxiliary chamber into which exhaust gas from the exhaust gas outlet is introduced; and another gas burner disposed with the auxiliary chamber to circulate and heat the exhaust gas in the auxiliary chamber.

7. The cyclonic plasma pyrolysis/vitrification system of claim 3, wherein the downardly extending separator wall is located between the cyclonic gas flow and the exhaust gas outlet.

8. The cyclonic plasma pyrolysis/vitrification system of claim 7, wherein the exhaust gas outlet is formed in a ceiling of the main reactor.

* * * * *